United States Patent [19]

Legler

[11] 4,068,700

[45] Jan. 17, 1978

[54] DIVIDER SCREEN

[75] Inventor: George Legler, Kirkland, Canada

[73] Assignee: Precision Mfg Inc-Fabrication Precision Inv, St. Laurent, Canada

[21] Appl. No.: 708,030

[22] Filed: July 23, 1976

[51] Int. Cl.[2] ..... A47G 5/00

[52] U.S. Cl. ..... 160/351; 160/381

[58] Field of Search ..... 160/135, 351, 381; 52/238, 239, 281, 285; 211/182; 248/315, 539; 285/46

[56] References Cited

U.S. PATENT DOCUMENTS

| | | | |
|---|---|---|---|
| 546,081 | 9/1895 | Reyer | 248/315 |
| 2,923,351 | 2/1960 | Zitomer | 160/381 |
| 3,018,077 | 1/1962 | Buehler | 248/539 |
| 3,111,723 | 11/1963 | Bates | 160/135 |
| 3,592,289 | 7/1971 | Aysta | 160/135 |
| 3,987,838 | 10/1976 | LaGue et al. | 160/135 |

*Primary Examiner*—Peter M. Caun

*Attorney, Agent, or Firm*—Alan Swabey & Company

[57] ABSTRACT

The disclosure relates to a partition having vertical and horizontal frame members connected at a corner, each frame member having a web and side flanges each having a part extending inwardly to form with the web of panel receiving channel and a part extending outwardly to form a cap-receiving structure. Each frame member is provided with a pair of mounting flanges extending outwardly from the web, spaced from each other, and from the side flanges. The sides of each of the mounting flanges facing each other are provided with at least one groove. The frame members are mitered at the corners and abutted together so that their grooves meet at the corner. An angle member extends between the mounting flanges, fitting within grooves of the vertical and horizontal members of the corner and being connected to their webs to form a joint. A leg mounting bracket is provided extending between the mounting flanges and fitting within their grooves at the bottom of the vertical frame member and connected to each web. The bracket has a leg projecting below the bottom of the frame member to receive a supporting member, for example, a glide or foot. An enclosure member shields the leg for aesthetic purposes and is made up of telescopically inner and outer cup members enclosing the leg and shank.

7 Claims, 10 Drawing Figures

DIVIDER SCREEN

BACKGROUND OF THE INVENTION

This invention relates to a panel construction.

More particularly, it relates to the construction of panels of the type shown generally in Swedish Pat. No. 371,740 (application 7300610-8, filed Jan. 17, 1973) of Formfac International AB.

A panel of this type is provided at one edge with an outwardly facing arcuate surface covered with a mass of small hook members adapted to engage a mass of complementary members on an arcuate edge of another panel. In this way the panels may be connected by merely pushing together the respective edges. The edges of the panels may also be rotated against each other, while remaining connected, to vary the angle of the panels one to the other.

SUMMARY OF THE INVENTION

An aim of the present invention is to provide in panels of this type improved ease of assembly, panel size flexibility, panel stability, and other advantages. A further aim is to provide special standard hardware which may be easily applied to the panels.

The invention provides a panel having a special frame construction facilitating the connection of the frame members at the corners and, at the same time, providing for the mounting of a special leg-retaining bracket. The frame is also constructed to receive and retain the edges of the panel which it frames. It is also constructed to receive cap members provided with burr fastener means for connecting the panel to other panels and for providing a finish to the edges of the panel.

Each frame member has a web and side flanges extending inwardly and outwardly of the web. The inner side flanges form between them a channel for receiving the edge of the panel. The outer side flanges terminate in inwardly extending flanges forming a hardware enclosure and for receiving a cap member. Extending outwardly from the web are a pair of mounting flanges spaced from each other and from the side flanges. The sides of these flanges facing each other are provided with at least one registering hardware receiving groove.

The ends of the frame members are mitered and abutted together at the corners. Angle members engage in grooves of the corner abutting frame members and are secured to the respective webs so as to provide a strong corner joint.

The elongated base of a leg mounting bracket in slid into the grooves at the bottom of the vertical frame member and secured to the web of this member, with a leg protruding below the bottom horizontal frame member to receive a supporting foot.

In its preferred form, the foot supporting bracket is made up of a flat elongated bar formed to have a flange at each end and an intermediate part having connector receiving openings. An elongated leg mounting member, connected to both flanges, extends lengthwise of the bar parallel to it and has one end extending through an opening in one flange and extending beyond it to provide a foot mounting leg. An intermediate part of the foot mounting member is narrowed to provide access to openings in the bar. The leg is preferably tubular and threaded outside and inside.

Another feature of the invention is an aesthetic enclosure structure for the leg. The structure is made up of telescopically inner and outer cup members enclosing the leg. One cup member is inverted and has a cap provided with an opening receiving the leg and a downwardly extending skirt. The other cup member has a skirt slideable against the one cup member and a cap having an opening surrounding the leg and bearing against the foot part whereby the other cup member can move up and down telescopically on the one cup member, as the foot is raised or lowered.

A further preferred feature of the invention is to provide a cup member having a skirt as a cap provided with a central opening and surrounding the central opening with a detachable annular part removable to provide a larger opening.

Among the features of the invention, therefore, are the overall construction of the frame including the corner joint, the construction of the frame members themselves, the preferred leg mounting bracket and the way it is mounted on the frame and the telescopic leg enclosure.

BRIEF DESCRIPTION OF THE DRAWINGS

Having thus generally described the invention, it will be referred to more particularly by reference to the drawings, showing preferred embodiments, and in which.

DESCRIPTION OF THE PREFERRED EMBODIMENTS

In accordance with the invention, a panel A is provided with a base frame made up of similar frame members B, $B_1$ and $B_2$ at the vertical margins and top horizontal margin of the panel and a frame member $B_3$ along the bottom horizontal margin.

The frame members are preferably aluminum extrusions. They are mitered at each end and the mitered corners of neighbouring extrusions abut to form secure joints at the corners of the panel.

Figure 1:
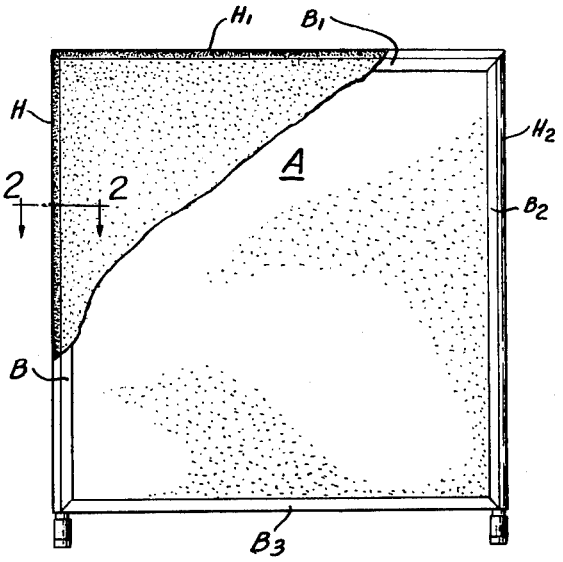
FIG. 1 is an elevation of a screen, according to the invention.
Figure 2:
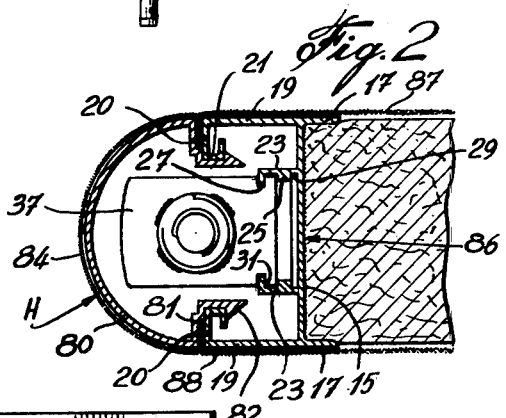
FIG. 2 is a greatly enlarged horizontal cross-section along the lines 2—2 of FIG. 1.
Figure 3:
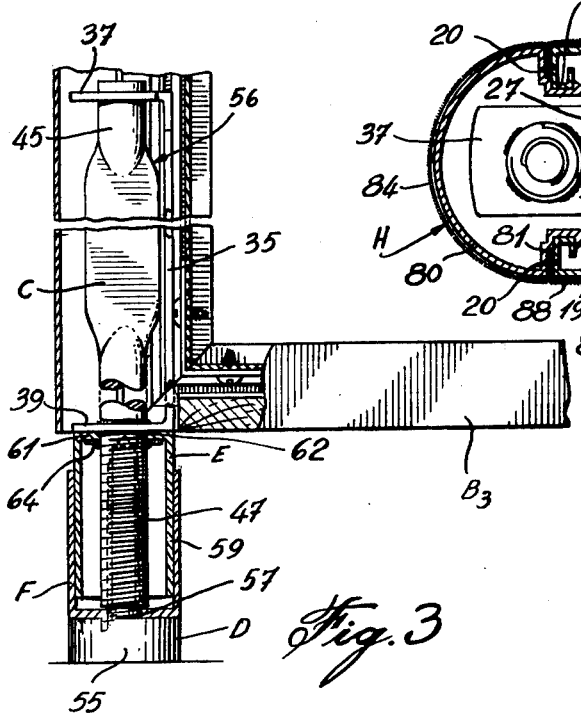
FIG. 3 is a greatly enlarged fragmentary vertical cross-section partly in elevation of a lower corner of the screen showing a leg for mounting a glide or foot.
Figure 4:
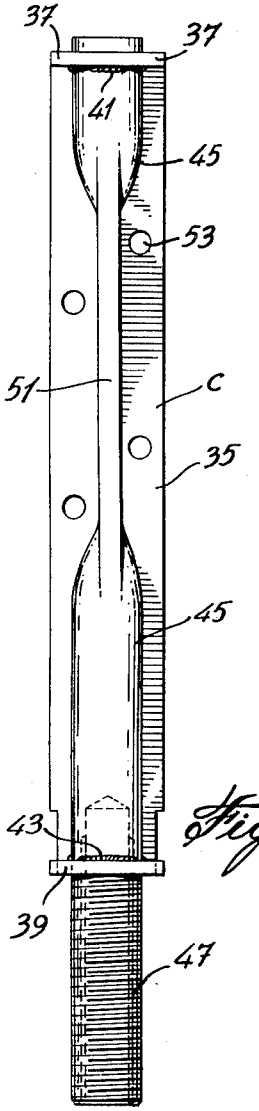
FIG. 4 is a front elevation of a leg and its mounting hardware.
Figure 5:
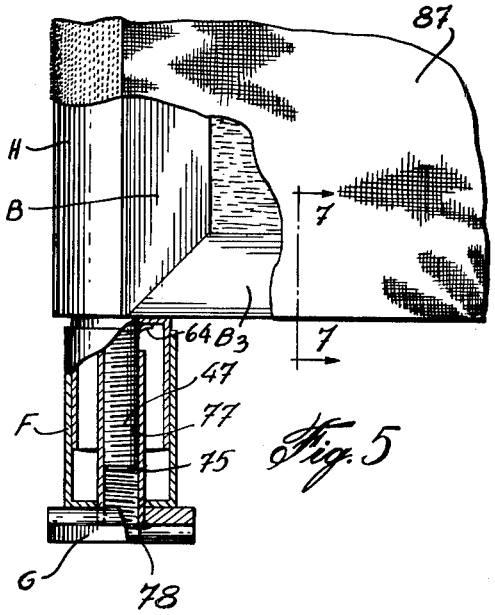
FIG. 5 is a side elevation partly in section showing the glide mounting and extensible enclosure.
Figure 6:
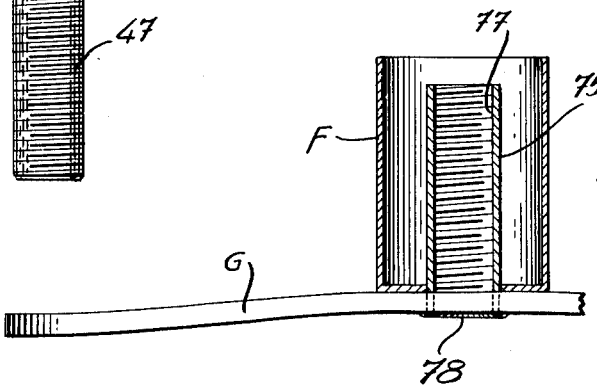
FIG. 6 is a greatly enlarged detailed cross-section partly in elevation of the foot with the covering member.

As shown, in cross-section, in FIG. 2, the member B has a web 15 and, perpendicular to it, side flanges each having an inner part 17 extending inward and an outer part 19 extending outward of the panel. The side flanges 19 have inward extensions 20 which terminate in substantially U-shaped ends 21 and form the sides of a hardware enclosure.

Figure 7:
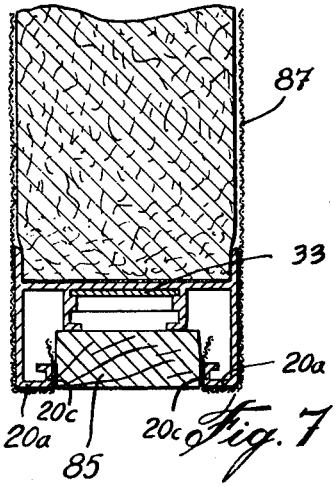
FIG. 7 is a greatly enlarged vertical cross-section along the lines 7—7 of FIG. 5.
Figure 10:
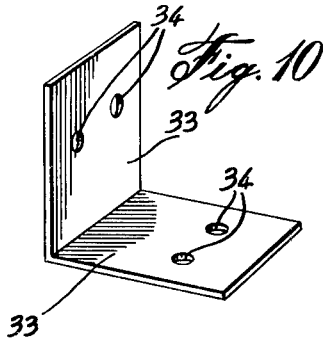
FIG. 10 is an enlarged perspective view of a corner strap.

Extending outwards perpendicularly from the web 15 are flanges 23 equally spaced from their respective adjacent flanges 19 and from each other. Each flange 23 has extending along its length spaced apart longitudinal ribs 25 and 27. Each rib 25 forms between it and the web 15 a groove 29. Each rib 27 forms between it and the rib 25 a groove 31. The extrusions B, $B_1$ $B_2$ and $B_3$ are of the same construction. The bottom horizontal extrusion $B_3$ differs in the U-shaped end on the inward extensions **20*a* which are replaced by a rather L-shaped end 20*c* (see FIG. 7). The flanges 23 serve to stiffen the web 15** against flexure, as well as providing connecting and mounting functions to be described.

At the bottom left hand corner of the panel, where the mitered adjoining ends of the members B and $B_3$ abut, the groove 29 of each receives one leaf of an L-shaped corner strap 33 to hold together the abutting corners of the respective extrusions B and $B_3$. Each strap 33 had holes 34 through which self-tapping screws are screwed into the web 15 of the underlying extrusions. The connection between the ends of the extrusions B and $B_1$, $B_1$ and $B_2$, and $B_2$ and $B_3$ are similarly effected.

The groove 31 at the lower part of the vertical extrusion B receives a bracket C made up of a narrow rigid elongated body 35 having parallel sides and at one end a flange 37 and the other end flange 39. The flanges 37 and 39 are provided with respective openings receiving a tube 45 extending between the respective flanges and having its ends welded to them as at 41 and 43. The tube 45 has a threaded leg 47 extending beyond the flange 39. The leg 47 is also internally tapped. An intermediate part 51 of the tube 45 is flattened to give access to fastening openings 53 on the body 35.

The body 35 of the bracket C slides snugly into the groove 31 of the extrusion B, and once in position, the body 35 is connected to the web 15 by self-tapping screws 56 extending through the openings 53 in the body 35 and into the web 15.

A glide D has a head 55 and a threaded shank 57 screwed into the tapped end 47 of the bracket C. The screen A can be levelled by screwing the glide in or out as required in coordination with the glide at the other end of the panel.

For aesthetic purposes a covering structure is provided to enclose the threaded shank 57. This structure is adjustable in height to conform with the adjustment of the glide. The covering structure includes an inner cup E, having a cylindrical skirt 59 and an end cap 61 provided with a central opening 62 receiving the leg 47.

A flexible washer 64 attached to the underside of the cap 61 surrounding the opening 62 engages the leg 47 so that the cup can be pushed on to the leg, but has to be screwed off. An outer cup F has a skirt 65 having a sliding fit on the outside of the cup E. The cup F has an end cap 67 provided with a central opening 69 having a loose fit on the shank 57 of the glide D.

Figure 8:
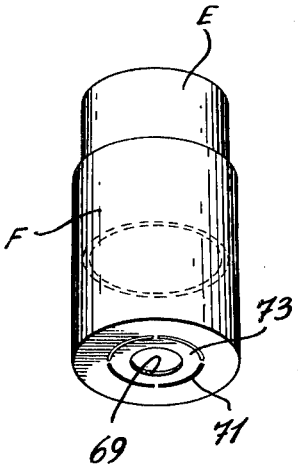
FIG. 8 is an enlarged bottom perspective view of a form of leg enclosure member.
Figure 9:
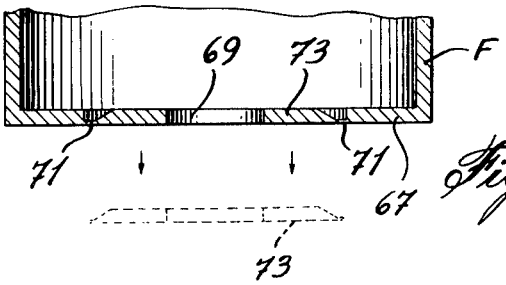
FIG. 9 is a still further enlarged cross-section showing the construction of an enclosure member permitting its accommodation to leg parts of different sizes.

The cap 67 of the cup F (see FIG. 8) may also be provided with a circular weakened ring 71 defining a disc 73 which can be pushed out of the cap 67 by rupturing the weakened ring. Removing the disc 73 forms a larger opening.

This larger opening is employed in the case of the construction where a foot G is attached. The foot G has an upwardly extending tube 75, internally tapped at 77, so that the tube 75 threadably engages the threaded leg 47. The openings left by removal of the disc 73 centers the sleeve 75 over the leg 47. A weld 78 secures the tube 75 to the foot G.

The panel A can be levelled by raising or lowering the foot G in conjunction with a foot at the other end of the panel, by rotating it clockwise or counterclockwise, as the case may be. The inner cap E remains fixed relative to the leg 47. The outer sleeve moves up or down with the foot G as with the glide D.

Mounted on the frame members B, $B_1$ and $B_2$ are elongated cap members H, $H_1$ and $H_2$. Thse cap members are each made up of an elongated shell having a body 80 of springable material, semi-circular in cross-section and having terminal inwardly extending flanges 81 provided with hooked ends 82 for engaging the ends 21 of the frames B, $B_1$ and $B_2$. The members H are sprung into place as best shown in FIG. 2.

The vertical frame members H and $H_2$ are provided with a covering of a burr fastener fabric 84, for example BELL-TOUCH fabric. The surface of the vertical cap member H is provided on the surface thereof with the male fabric and the surface of the cap member $H_2$ with the female type fabric so that the panels can be releasably connected to the vertical cap members of adjacent panels provided with complementary fabric.

The bottom frame member $B_3$ instead of being capped with a cap member, is finished with an elongated wooden plug 85 which engages between the flange ends **20*c* to form with the inwardly extending flange 20*a*** a flat face on the bottom of the panel frame.

The panel A proper is made up of sound absorbing material as well known in the art. The panel is provided with a marginal part 86 which is firmly held within the channel formed by the web 15 and the flange parts 17. A fabric cover 87 is applied over the panel A and extends over the sides of the frame members B, $B_1$, $B_2$ and $B_3$ and is held thereto by adhesive strips 88. The margins of the cover 87 may be turned in with the margins of the fabric 84 and held in the gap between the flange 20 of the frame member B and the flange 81 of the cap member H. At the bottom, the cover 87 is turned in and held between the flange **20*c* of the frame member $B_3$ and the plug 85**.

The selection of appropriate materials from which the various parts are made will be apparent to those skilled in the art, for example the frame members are preferably aluminum extrusions. The bracket C is of any suitable metal. The cap members H may be aluminum extrusions. The cup members E and F may be of plastic material.

I claim:

1. A partition with vertical and horizontal frame members having mitered ends which are interconnected at the corners of the partition;

each frame member including a web and an integral pair of first flanges extending along the length thereof, each first flange terminating in an inwardly directed extension, the inwardly directed extensions of the vertical and upper horizontal frame members releasably engaging cooperating hooked ends of respective cap members which are releasably secured to the frame members, each cap member having a semicylindrical outer surface extending the length thereof;

each frame member being provided with a pair of spaced-apart second flanges extending the length of the frame members and situated between the first flanges, the second flanges being integral with and extending outwardly from the web in the direction of the first flanges and terminating short of the inwardly directed extensions of the first flanges, the second flanges stiffening the web of the frame member against binding forces applied thereto;

each of the cap members releasably connected to the vertical frame members having one of a pair of cooperating tape fasteners connected to the cylindrical outer surface thereof;

an inner surface of each of the second flanges being provided with a pair of spaced-apart grooves extending along a length thereof, the grooves of adjacent frame members meeting at the corners of the partition, the grooves forming cooperating pairs of inner and outer grooves in each cooperating pair of second flanges;

an angle member interconnecting adjacent horizontal and vertical frame members at each corner of the partition, the legs of each angle member being mounted in the inner grooves of the second flanges and being releasably secured in position by means of fasteners extending through openings in the legs of the angle members and engaging cooperating openings in respective webs of the frame members, whereby secure corner joints of the frame members are provided at each corner of the partition; and a partition leg mounted on each of the lower corners of the partition, each leg having a respective mounting bracket engaging a respective outer pair of cooperating grooves at the lower ends of one of the vertical frame members, the mounting brackets being releasably secured to the webs of the vertical frame members by threaded fasteners, the partition legs extending downwardly below the lower horizontal member and having a supporting member releasably connected thereto, the leg being a thick-walled tubular member, inner and outer surfaces of which are threaded to releasably connect the supporting member thereto, a pair of telescopically arranged cup members mounted on the leg between a lower edge of the panel and the support member, each cup member having a circular end wall and a cylindrical side wall extending at right angles thereto, the circular end walls of the cup; members having aligned openings therein for mounting of the cup members on the leg, adjacent ends of the cylindrical side walls of the telescopic cup members being in overlapping sliding engagement and moving relative to each other upon adjustment of the support member on the leg, an upper cup member being releasably secured to the leg adjacent a lower end of the leg mounting bracket and a lower cup member resting on an upper surface of the support member, the telescopically arranged cup members concealing the leg from view upon adjustment of the support member relative to the leg.

2. A partition as claimed in claim 1, wherein each frame member web has a pair of spaced-apart wall members extending rearwardly from the web and at right angles thereto, the web and wall members forming a receiving channel for fitting over an edge of a core portion of the partition.

3. A partition as claimed in claim 1, wherein the leg mounting bracket comprises a flat rear wall with flanges extending from one side of the bracket adjacent upper and lower ends thereof, a tube extends between the inner surfaces of the mounting bracket flanges and is welded at an upper end to the upper flange, the leg extends through a cooperating opening in the lower flange and is secured to a lower end of the tube, the leg and tube being welded to the lower flange and the leg extending downwardly beneath the lower flange.

4. A partition as claimed in claim 3, wherein the tube is flattened intermediate its length to provide access for fasteners to secure the flat rear wall of the mounting bracket to the web of the frame member.

5. A partition as claimed in claim 1, wherein the circular end wall of the lower cup member has a narrow weakened zone situated concentrically about the opening in the end wall thereof, so as to define a removable annular end wall portion, the annular end wall portion adapted to be removed from the end wall of the lower cup member to permit passage of a larger shank portion of a support member, the larger shank portion being internally threaded so as to releasably engage the externally threaded portion of the leg, the larger shank portion having a flat elongated foot portion securely attached to a lower end thereof.

6. A partition as claimed in claim 1, wherein the support member comprises a glide having a threaded stud extending upwardly therefrom, the threaded stud releasably engaging the internally threaded portion of the leg.

7. A partition as claimed in claim 1, wherein the core of the panel is sound absorbent and a finishing fabric covers the flat side surfaces of the panel, the fabric covering outer surfaces of the frame members, with margins of the fabric being secured to the frame members at locations between the frame members and the respective cap members.

* * * * *